US007301094B1

(12) United States Patent
Noro et al.

(10) Patent No.: US 7,301,094 B1
(45) Date of Patent: Nov. 27, 2007

(54) DEVICE FOR DRIVING VIBRATION SOURCE

(75) Inventors: Masao Noro, Hamamatsu (JP); Takahiro Tanaka, Zushi (JP); Nobukazu Toba, Hamamatsu (JP); Kiyoshi Yamaki, Iwata-gun (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 10/110,871

(22) PCT Filed: Oct. 23, 2000

(86) PCT No.: PCT/JP00/07378

§ 371 (c)(1),
(2), (4) Date: Apr. 18, 2002

(87) PCT Pub. No.: WO01/28699

PCT Pub. Date: Apr. 26, 2001

(30) Foreign Application Priority Data

Oct. 22, 1999 (JP) ..... 11/301752

(51) Int. Cl.
*G10H 7/00* (2006.01)

(52) U.S. Cl. ..... 84/645; 181/144

(58) Field of Classification Search ..... 181/144; 379/418; 361/99, 100, 103; 84/645; 381/99, 381/100, 103
See application file for complete search history.

(56) References Cited

U.S. PATENT DOCUMENTS 4,354,067 A 10/1982 Yamada et al.
4,412,106 A * 10/1983 Pavel ..... 381/309
4,674,743 A * 6/1987 Hirano ..... 482/8
4,753,148 A 6/1988 Johnson
4,779,615 A * 10/1988 Frazier ..... 601/47
5,076,260 A * 12/1991 Komatsu ..... 601/59
5,553,148 A 9/1996 Werle
5,951,500 A * 9/1999 Cutler ..... 601/47
6,027,463 A * 2/2000 Moriyasu ..... 601/46
6,120,468 A * 9/2000 Tseng ..... 601/46
6,208,237 B1 * 3/2001 Saiki et al. ..... 340/388.1

(Continued)

FOREIGN PATENT DOCUMENTS

CN 1075240 A 8/1993

(Continued)

OTHER PUBLICATIONS

Dec. 5, 2002 letter from Wagner & Geyer transmitting Supplemental Search Report, with date-of-receipt stamp showing Dec. 9, 2002 date that documents were received from European associate.

(Continued)

*Primary Examiner*—Lincoln Donovan
*Assistant Examiner*—David S. Warren
(74) *Attorney, Agent, or Firm*—Pillsbury Winthrop Shaw Pittman LLP

(57) ABSTRACT

A vibration source driving device that realizes various vibration functions on portable telephones. The vibration source driving device includes a sound source for generating musical tone signals in response to music data. A vibration source to generate vibration, a driver to drive the vibration and a control circuit are further included such that the vibration source may be driven in synchronization with the rhythm signal within the music data.

7 Claims, 13 Drawing Sheets

U.S. PATENT DOCUMENTS

| | | | | |
|---|---|---|---|---|
| 6,255,937 | B1 * | 7/2001 | Hamaguchi | 340/384.7 |
| 6,275,477 | B1 * | 8/2001 | Trompower et al. | 370/313 |
| 6,281,785 | B1 * | 8/2001 | Hamaguchi | 340/407.1 |
| 6,574,489 | B1 | 6/2003 | Uriya | |
| 2004/0097851 | A1 * | 5/2004 | Inada et al. | 601/47 |

FOREIGN PATENT DOCUMENTS

| | | | |
|---|---|---|---|
| EP | 0 866 592 | A | 9/1998 |
| EP | 888 032 | A | 12/1998 |
| EP | 00 96 9989 | | 1/2000 |
| EP | 1 170 709 | | 1/2002 |
| JP | S60-27582 | | 2/1985 |
| JP | 03119900 | A | 5/1991 |
| JP | 06104962 | | 4/1994 |
| JP | 08-238901 | H | 9/1996 |
| JP | 10-272417 | | 10/1998 |
| JP | H10-272417 | | 10/1998 |
| KR | 8200936 | | 5/1982 |

OTHER PUBLICATIONS

Korean Patent Office, Korean Official Action, Mar. 7, 2005.
European Search Report for Application No. 04022452.9-1240, dated Dec. 6, 2004.
Office Action, Korean Patent Office, dated Oct. 22, 2004.
Chinese Patent Office, Office Action, Sep. 2, 2005.
"Office communication," European Patent Office (Europe), (Apr. 4, 2006).

* cited by examiner

DEVICE FOR DRIVING VIBRATION SOURCE

This application is the National Phase of International Application PCT/JP00/07378 filed Oct. 23, 2000 which designated the U.S.

TECHNICAL FIELD

The present invention relates to vibration source driving devices, and particularly to vibration source driving devices that realize vibration functions on portable telephones.

BACKGROUND ART

The conventional portable telephones are each constituted to allow the setting for a vibrator to be driven at an incoming call mode in order to notify an incoming call by causing vibration other than a melody and the like. Generally, this vibrator has a DC motor in which a weight is attached in a deflected manner to a rotation shaft of a rotor; therefore, by driving it to rotate, vibration is generated.

By the way, the aforementioned portable telephones can be each set to notify users with incoming calls with both sound and vibration by driving the vibrator simultaneously with generation of the melody and the like.

However, the sound such as the melody of the musical tune does not have correlation to the vibration; therefore, when the conventional telephone is used with the setting for allowing incoming call notification by simultaneously generating sound and vibration, there is a problem in that the user of the portable telephone may have a feeling of wrongness.

As a vibration source, a vibration speaker having a vibration function is known. The vibration speaker is set such that the resonance frequency of the cone side differs from the resonance frequency of the magnet side; therefore, it is constituted such that the sound output and the vibration are generated in different frequency bands respectively. In the conventional portable telephones, vibration speakers have not been known as constituent elements for realizing vibration functions. This is because in order to reliably generate vibration using a vibration speaker, it is necessary to control the frequency characteristic of the drive system of the vibration speaker to follow up with variations of the resonance frequency of the magnet side of the vibration speaker causing the vibration. For this reason, there is a problem that the circuit configuration should be complicated.

The present invention is made in consideration of the aforementioned circumstances; and it is a first object to provide a vibration source driving device, as a means for realizing a vibration function on the portable telephone and the like, in which at an incoming call mode when both sound and vibration are simultaneously generated to perform incoming call notification, a correlation is introduced between the vibration and the sound corresponding to the melody of the musical tune, so that the user is able to enjoy it without having a feeling of wrongness.

In addition, it is a second object of the present invention to provide a vibration source driving device, as a means for realizing a vibration function on the portable telephone and the like, in which a vibration speaker used as a vibration source can be driven without using the complicated circuit configuration.

DISCLOSURE OF INVENTION

In order to achieve the first object, the present invention is characterized by comprising a sound source for generating musical tone signals, a vibration source for generating vibration, a signal extraction means for extracting low-frequency components from the musical tone signals output from the sound source, and a drive means for driving the vibration source based on the low-frequency components of the musical tone signals that are extracted by the signal extraction means.

In the aforementioned configuration, the low-frequency components are extracted from the musical tone signals output from the sound source, so that the vibration source is driven based on the low-frequency components of the musical tone signals. Therefore, in the case of the portable telephone that is set to allow incoming call notification by both the sound (i.e., melody of the musical tune) and vibration, the vibration occurs in synchronization with the rhythm of the musical tune that is output as the sound. Hence, it is possible to obtain an effect that the user is able to enjoy it without having a feeling of wrongness.

In addition, the present invention is characterized by comprising a sound source for generating musical tone signals, a vibration source for generating vibration, a drive means for driving the vibration source, a switch means provided between the sound source and vibration source, and a control means for controlling the drive means such that by performing on/off controls on the switch means based on the output timing of a rhythm signal within the musical tone signals output from the sound source, the vibration source is driven in synchronization with the rhythm signal.

In the aforementioned configuration, driving the vibration source responsive to the low-frequency components of the musical tone signals output from the sound source is realized by the control means that performs on/off controls on the switch means, provided between the sound source and amplifier 22, based on the timing signal representing the output period of the rhythm signal, which represents the rhythm sound within the musical tone signals output from the sound source 10. Therefore, in the case of the portable telephone that is set to allow incoming call notification by both the sound (i.e., melody of the musical tune) and vibration, the vibration occurs in synchronization with the rhythm of the musical tune that is output as the sound. Hence, it is possible to obtain an effect that the user is able to enjoy it without having a feeling of wrongness.

In order to achieve the second object, the present invention is characterized by comprising a sound source for generating musical tone signals, a vibration source that provides a first vibration system for causing resonance in a first frequency band and a second vibration system for causing resonance in a second frequency band that is lower than the first frequency band so that the first vibration system generates sound and the second vibration system generates vibration, a variable filter that allows a changeover of the signal passing band for the musical tone signals output from the sound source in response to the setting signal externally provided, and a drive means for driving the vibration source based on the output of the variable filter. Herein, filter constants of the variable filter are set based on the setting signal, so that the variable filter acts as a low-pass filter whose cutoff frequency substantially matches the upper-limit frequency of the second frequency band in order that the vibration source functions as only a vibrator; it acts as a high-pass filter whose cutoff frequency substantially matches the lower-limit frequency of the first frequency band in order that the vibration source functions as a speaker for reproducing sound signals; or it is placed in the through state allowing transmission of all signals in order that the vibration source functions to reproduce sound signals and to generate vibration.

The present invention is characterized by comprising a sound source for generating musical tone signals and vibration signals, a vibration source that provides a first vibration system for causing resonance in a first frequency band and a second vibration system for causing resonance in a second frequency band that is lower than the first frequency band so that the first vibration system generates sound and the second vibration system generates vibration, an addition means for adding together the musical tone signals and vibration signals output from the sound source, and a drive means for driving the vibration source based on the output signal of the addition means.

The present invention is characterized by comprising a sound source for generating musical tone signals based on music data and for generating vibration signals based on and synchronized with rhythm data within the musical data, a vibration source that provides a first vibration system for causing resonance in a first frequency band and a second vibration system for causing resonance in a second frequency band that is lower than the first frequency band so that the first vibration system generates sound and the second vibration system generates vibration, a rhythm data detection means for detecting the rhythm data from the musical tone signals output from the sound source and for outputting them to the sound source, a high-pass filter for removing low-frequency sounds from the musical tone signals, a low-pass filter for removing higher harmonics components from the vibration signals, an addition means for adding together the output signal of the high-pass filter and the output signal of the low-pass filter, and a drive means for driving the vibration source based on the output signal of the addition means.

The present invention is also characterized by that in the aforementioned vibration source driving device, the vibration source is a vibration speaker.

In the present invention having the aforementioned configuration, the vibration speaker for generating sound and vibration in different frequency bands is used as the vibration source, which is driven by signals transmitted through the variable filter that can change frequency characteristics of the musical tone signals output from the sound source by the setting input. Therefore, when the vibration speaker is used as the vibration source, that is, the means for actualizing the vibration function on the portable telephone that allows generation of sound (acoustic sound or speech) only, generation of vibration only, or simultaneous generation of sound and vibration, it can be driven by the normal speaker drive amplifier without using the complicated circuit configuration. When the portable telephone is set to allow notification of an incoming call by both sound (melody of the tune) and vibration, the vibration is generated in synchronization with the rhythm of the tune that is output as the sound; therefore, it is possible to obtain an effect that the user can enjoy it without having a feeling of wrongness.

Further, in the present invention having the aforementioned configuration, the sound source generates musical tone signals as well as vibration signals in the prescribed frequency band causing resonance by the vibration system that generates vibration on the vibration speaker as the vibration source, so that the vibration speaker is driven by the added signals of the musical tone signals and vibration signals. Therefore, when the vibration speaker is used as the vibration source, that is, the means for actualizing the vibration function on the portable telephone, it can be driven by the normal speaker drive amplifier without using the complicated circuit configuration.

When the portable telephone is set to allow notification of an incoming call by both sound (melody of the tune) and vibration, it is possible to generate vibrations having different characteristics in response to the vibration signals generated by the sound source. Hence, it is possible to obtain an effect that the user can enjoy it without having a feeling of wrongness.

In the present invention, the signals that is extracted by eliminating low-frequency components from the musical tone signals output from the sound source are added to the vibration signals that are synchronized with the rhythm within the musical tone signals output from the sound source, so that the vibration speaker as the vibration source is driven by the addition output. Therefore, when the vibration speaker is used as the vibration source, that is, the means for actualizing the vibration function on the portable telephone, it is possible to obtain an effect that the vibration source can be driven by the normal speaker drive amplifier without using the complicated circuit configuration.

When the portable telephone is set to allow notification of an incoming call by both sound (melody of the tune) and vibration, the vibration is generated in synchronization with the rhythm of the tune that is output as the sound. Therefore, it is possible to obtain an effect that the user can enjoy it without having a feeling of wrongness.

BEST MODE FOR CARRYING OUT THE INVENTION

The embodiments of the present invention will be described with reference to the drawings. The embodiments of the present invention describe applications for portable telephones in which the present invention is applied to vibration functions; however, the present invention is not necessarily limited by the embodiments.

First Embodiment

Figure 1:
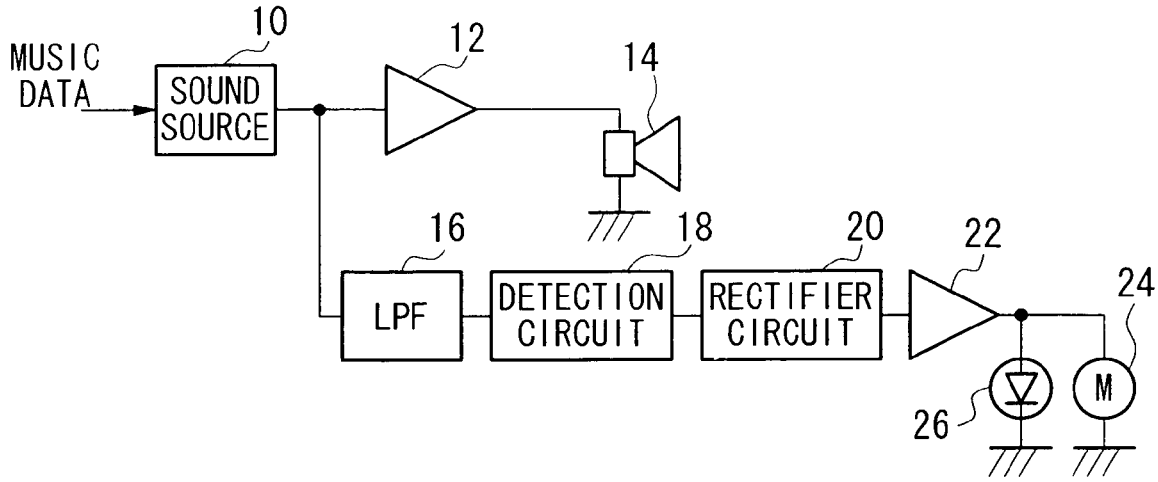
FIG. 1 is a block diagram showing the configuration of a vibration source driving device in accordance with a first embodiment of the present invention.

FIG. 1 shows the configuration of the vibration source driving device in accordance with the first embodiment of the present invention. In this figure, the vibration source driving device of the first embodiment comprises a sound source 10 for generating musical tone signals, a DC motor 24 as a vibration source for generating vibration, a low-pass filter (LPF) 16 as a signal extraction means for extracting low-frequency components from the musical tone signals output from the sound source 10, a detection circuit 18 for performing detection on the output signal of the low-pass filter 16, a rectifier circuit 20 for rectifying the detection output of the detection circuit 18, and an amplifier 22 as a drive means for driving the vibration source based on the low-frequency components of the musical tone signals extracted by the low-pass filter 16.

12 designates an amplifier for amplifying musical tone signals output from the sound source 10; 14 designates a speaker that is driven by the output of the amplifier to generate sound based on the musical tone signals; and 26 designates a photodiode for flickering light in display in synchronization with vibration. A DC motor 24 has a weight that is attached to its rotation shaft in a deflected manner; and it is designed to generate vibration for the portable telephone body by rotating the weight. The sound source is for example an FM sound source, which outputs musical tone signals based on input music data. As the sound source, it is possible to use any types of sound sources such as PCM sound sources that can generate musical tone signals.

In the aforementioned configuration, when an incoming call is received by the portable telephone that is set to allow notification of the incoming call by both sound (melody) and vibration, the sound source 10 is driven to generate musical tone signals representative of the melody of the prescribed tune based on the input music data, so that it outputs the musical tone signals to the amplifier 12 and the low-pass filter 16 respectively. As a result, the speaker 14 outputs the sound based on the musical tone signals.

Meanwhile, the low-pass filter 16 extracts low-frequency components from the musical tone signals output from the sound source 10.

Figure 2:
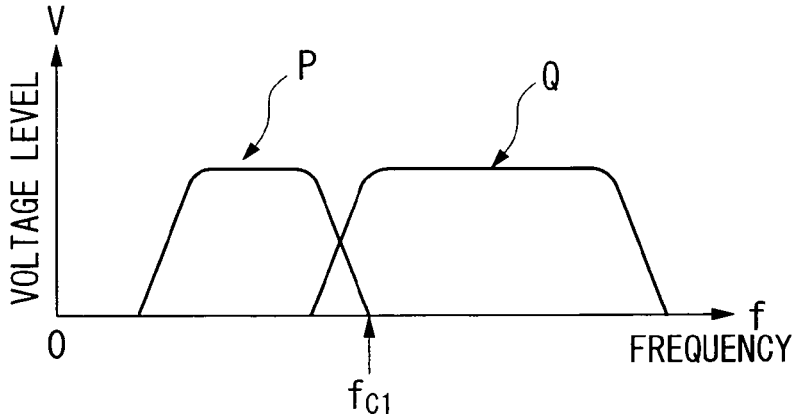
FIG. 2 is a characteristic graph showing frequency characteristics of musical tone signals produced by a sound source shown in FIG. 1.
Figure 3:
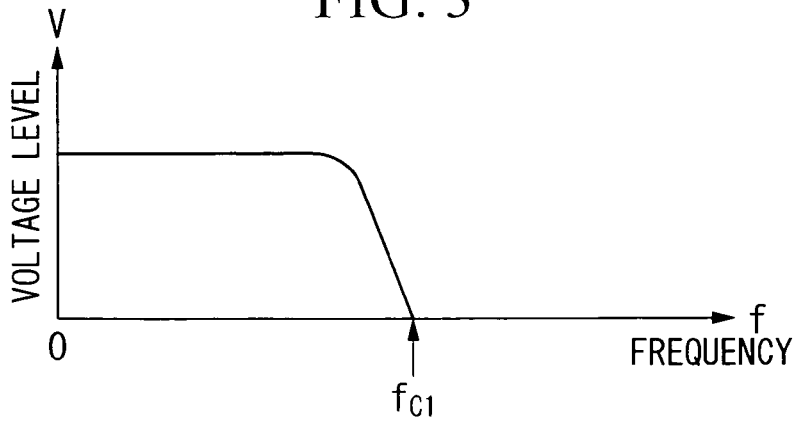
FIG. 3 is a characteristic graph showing a frequency characteristic of a low-pass filter shown in FIG. 1.

FIG. 2 shows frequency characteristics of the musical tone signals output from the sound source 10. In this figure, the curve P represents the frequency characteristic for the low-frequency components of the musical tone signals; and the curve Q represents the frequency characteristic for the high-frequency components of the musical tone signals. The symbol fc1 designates the upper-limit frequency for the low-frequency components of the musical tone signals. FIG. 3 shows the frequency characteristic of the low-pass filter 16. As shown in this figure, filter constants are selected in such a manner that the cutoff frequency fc1 becomes identical to fc1 in the frequency characteristic of the low-pass filter 16. Therefore, the low-pass filter 16 extracts the low-frequency components in the frequency characteristic designated by the curve P within the musical tone signals.

Figure 4:
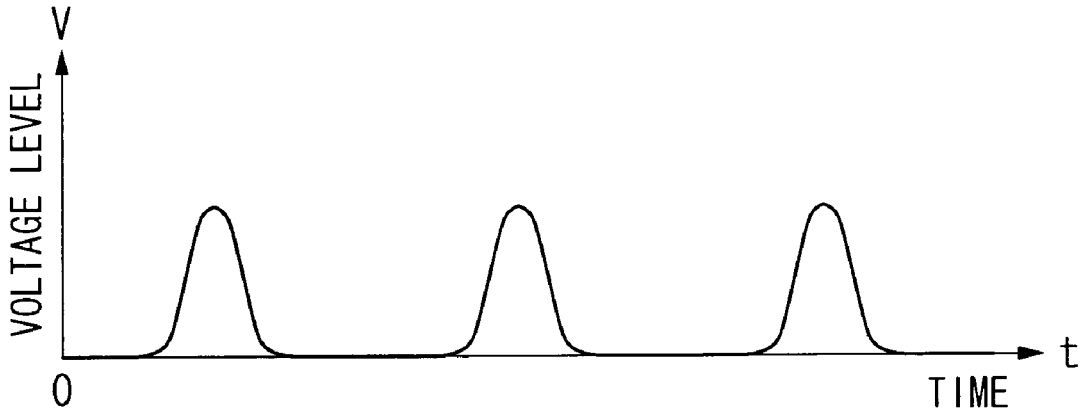
FIG. 4 is a graph showing a waveform of an output signal of a rectifier circuit shown in FIG. 1.

The output signal of the low-pass filter 16 is detected by the detection circuit 18, so that the rectifier circuit 20 outputs the signal whose waveform is shown in FIG. 4. This signal is amplified by the amplifier 22 up to the prescribed level; then, it is applied to the DC motor 24 and the photodiode 26 respectively. As a result, the DC motor 24 is driven in synchronization with the low-frequency components of the musical tone signals output from the sound source 10, for example, the rhythm of the bass sound, so that the vibration is correspondingly generated. In addition, the photodiode 26 flickers light in synchronization with the vibration.

Therefore, the speaker 14 outputs the sound representative of the melody of the tune that is obtained by reproducing the musical tone signals output from the sound source 10 in the prescribed frequency range from high frequencies to low frequencies; and the DC motor 24 is driven in synchronization with rhythm sounds, which correspond to the low-frequency components extracted from the musical tone signals, thus generating vibration in synchronization with the rhythm sounds.

As described above, when the portable telephone is set to allow notification of an incoming call by both sound (melody of the tune) and vibration, the vibration source driving device of the first embodiment of the present invention generates vibration in synchronization with the rhythm of the tune that is output as the sound; therefore, it is possible to obtain an effect that the user can enjoy it without having a feeling of wrongness.

Second Embodiment

Figure 5:
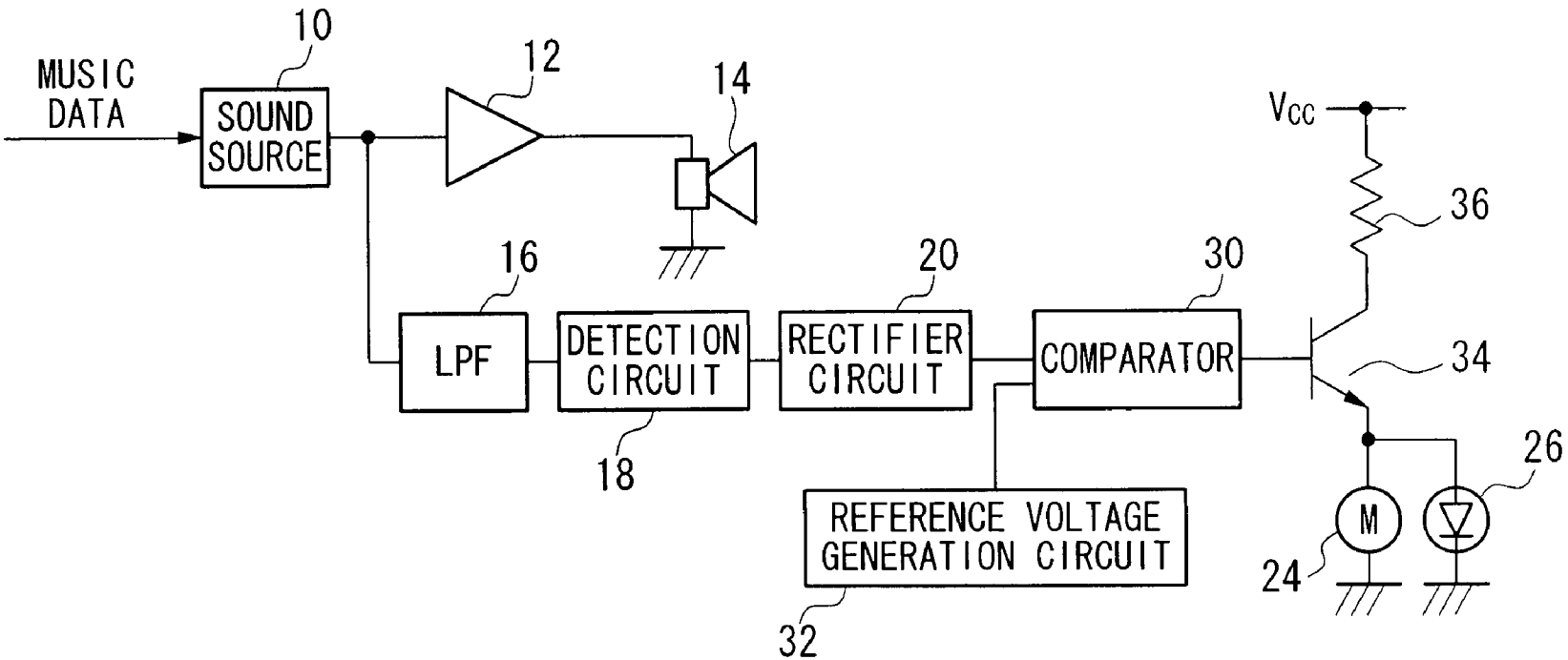
FIG. 5 is a block diagram showing the configuration of a vibration source driving device in accordance with a second embodiment of the present invention.

Next, FIG. 5 shows the configuration of the vibration source driving device in accordance with the second embodiment of the present invention. The vibration source driving device of the second embodiment differs from the vibration source driving device of the first embodiment in configuration in that there are provided a comparator 30, a reference voltage generation circuit 32, a transistor 34 as a switching element to be turned on or off by the output of the comparator 30, and a resistor 36, at the output side of the rectifier circuit 20 shown in FIG. 1, wherein a power source Vcc is connected to one ends of the DC motor 24 and photodiode 26 via the resistor 36 and the transistor 34. Other parts of the configuration of the second embodiment are identical to the vibration source driving device of the first embodiment; therefore, the same parts are designated by the same reference numerals; hence, the duplicate description will be omitted.

In the aforementioned configuration, when an incoming call is received by the portable telephone that is set to allow notification of the incoming call by both sound (melody) and vibration, the sound source 10 is driven to generate musical tone signals representative of the melody of the prescribed tune based on the input music data, so that it outputs the musical tone signals to the amplifier 12 and the low-pass filter 16 respectively. As a result, the speaker 14 outputs the sound based on the musical tone signals.

Figure 6:
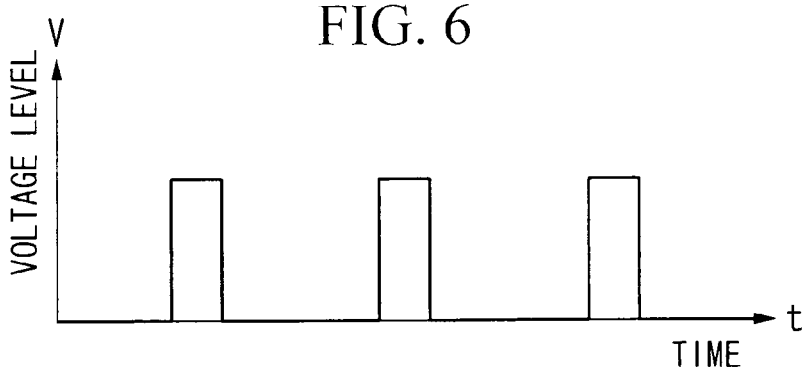
FIG. 6 is a graph showing a waveform of an output signal of a comparator shown in FIG. 5.

Meanwhile, it was described before that the output signal of the low-pass filter 16 is subjected to the detection of the detection circuit 18 and the rectification of the rectifier circuit 20, so that the signal shown in FIG. 4 can be obtained. The output signal of the rectifier circuit 20 is compared with the reference signal of the constant level output from the reference voltage generation circuit 32 by the comparator 30, so that the comparator 30 outputs a pulse string signal shown in FIG. 6 to the base of the transistor 34. Similar to the output signal of the rectifier circuit 20, this pulse string signal corresponds to the low-frequency components of the musical tone signals output from the sound source 10, concretely speaking, the rhythm signals.

The transistor 34 is controlled to be turned on or off in response to the pulse string signal, which is the output signal of the comparator 30; therefore, the power supply to the DC motor 24 and the photodiode 26 is being controlled.

Therefore, the speaker 14 outputs the sound representative of the melody of the tune that is obtained by reproducing the musical tone signals output from the sound source 10 in the prescribed frequency range from high frequencies to low frequencies; and the DC motor 24 as the vibration source is driven in synchronization with rhythm sounds, which correspond to low-frequency components extracted from the musical tone signals; the vibration is correspondingly generated in synchronization with the rhythm sounds. At this time, the photodiode 26 flickers light in synchronization with the vibration.

As described above, like the first embodiment, the vibration source driving device of the second embodiment of the present invention generates the vibration in synchronization with the rhythm of the tune, which is output as the sound, when the portable telephone is set to allow notification of an incoming call by both sound (melody of the tune) and vibration. Thus, it is possible to obtain an effect that the user can enjoy it without having a feeling of wrongness.

Third Embodiment

Figure 7:
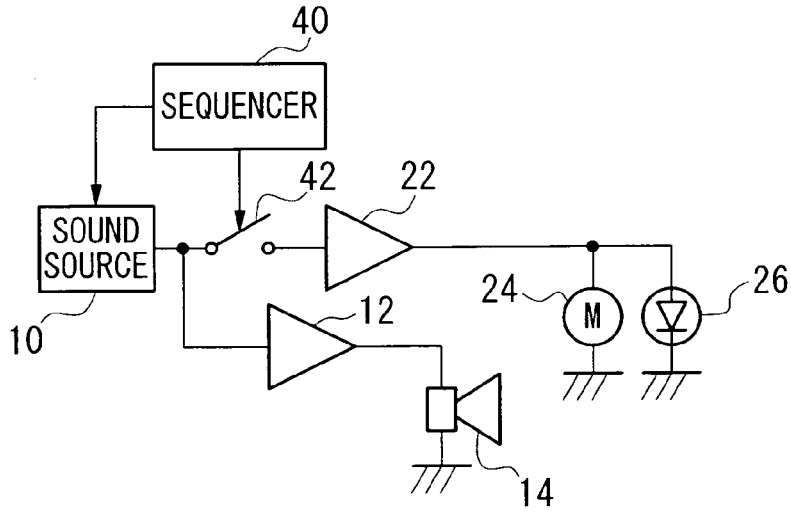
FIG. 7 is a block diagram showing the configuration of a vibration source driving device in accordance with a third embodiment of the invention.

Next, FIG. 7 shows the configuration of the vibration source driving device in accordance with the third embodiment of the present invention. The vibration source driving device of the third embodiment differs from the vibration source driving device of the first embodiment in configuration in that driving the DC motor as the vibration source by low-frequency components of musical tone signals output from the sound source 10 in the configuration of the vibration source driving device of the first embodiment shown in FIG. 1 is achieved by a sequencer 40 that controls a switch 42, which is provided between the sound source and the amplifier 22, to be turned on or off on the basis of timing signals representative of periods for outputting rhythm signals representing rhythm sounds within musical tone signals output from the sound source 10. The other parts of the configuration of the third embodiment are identical to the vibration source driving device of the first embodiment; therefore, the same parts are designated by the same reference numerals; hence, the duplicate description will be omitted.

Incidentally, the sequencer 40 has a counter therein. While this counter counts the time, during the periods that the sound source (e.g., FM sound source) outputs rhythm signals based on timing data, it controls the switch 42 to be in an ON state. The sequencer 40 corresponds to the control means of the present invention.

In the aforementioned configuration, the sequencer 40 has sequence data (music data) for the necessary channels, so that it controls the sound source 10 to be driven in parallel with the sequence data. Thus, the sound source 10 generates musical tone signals in the prescribed frequency range from high frequencies to low frequencies. The musical tone signals are supplied to the speaker 14 via the amplifier 12, so that the speaker outputs the corresponding sound based on the musical tone signals.

Figure 8:
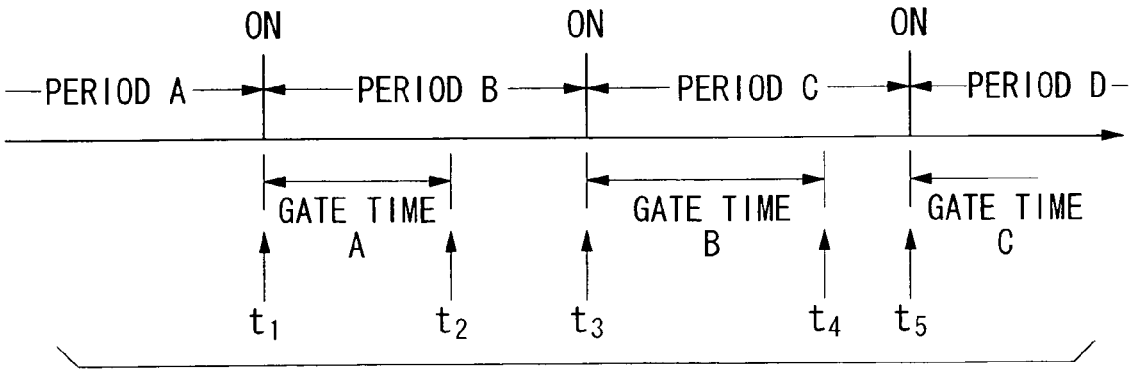
FIG. 8 is a timing chart showing operational states of a sequencer shown in FIG. 7.

Based on timing data representing timings of outputting rhythm signals representative of rhythm sounds within sequence data, concretely speaking, based on data designating periods for gate times A, B, C, . . . (ON at times t1, t3, and t5; OFF at times t2 and t4) shown in FIG. 8, the sequencer 40 controls the switch 42 to be turned on or off, thus supplying the rhythm signals to the DC motor 24 as the vibration source and the photodiode 26 respectively via the amplifier 22. As a result, the speaker 14 outputs as the sound the melody of the tune that is obtained by reproducing the musical tone signals output from the sound source 10 in the prescribed frequency range from low frequencies to high frequencies. The DC motor 24 as the vibration source is driven in synchronization with the rhythm sounds corresponding to low-frequency components of the musical tone signals, which are provided via the switch 24 that is turned on or off under the control of the sequencer 40. Thus, it generates vibration in synchronization with the rhythm sounds. At this time, the photodiode 26 flickers light in synchronization with the vibration.

As described above, like the first embodiment, the vibration source driving device of the third embodiment can generate the vibration in synchronization with the rhythm of the tune that is output as the sound when the portable telephone is set to allow notification of an incoming call by both sound (melody of the tune) and vibration. Thus, it is possible to obtain an effect that the user can enjoy it without having a feeling of wrongness.

Figure 9:
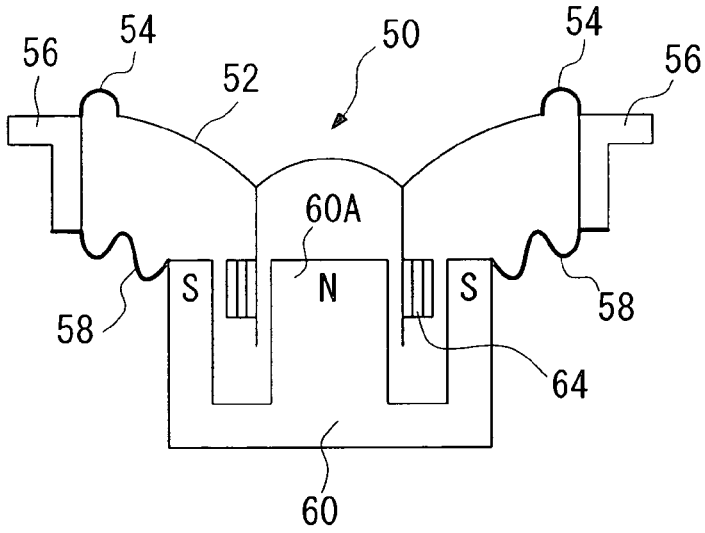
FIG. 9 is a schematic drawing for explaining the outline of the structure of a vibration speaker.

Next, descriptions will be given with respect to fourth to ninth embodiments, each of which provides a vibration source driving device using a vibration speaker as a vibration source. First, FIG. 9 shows the structure of the vibration speaker. In this figure, a vibration speaker 50 is constructed such that ends of a cone 52 is interconnected to and is supported by the upper end of a frame 56 via an edge 54.

A voice coil bobbin 62 about which a voice coil 64 is wound is fixed to the backside of the center portion of the cone 52 and is engaged with a pole piece 60A of a magnet 60. Further, the lower end of the frame 56 is interconnected to the upper end of the magnet 60 via an edge 58.

The vibration speaker 50 having the aforementioned structure provides two vibration systems, namely, a first vibration system containing the cone 52 and a second vibration system containing the magnet 60, wherein the second vibration system causes resonance in the prescribed frequency band that is lower than that of the first vibration system, thus causing vibration. These vibration systems are designed such that the first vibration system causes resonance in the first frequency band, for example, the frequency band ranging from 500 Hz to 1 kHz, while the magnet 60 causes resonance in the second frequency band ranging from 130 Hz to 145 Hz, for example. The cone 52 is subjected to constantly accelerated motion in frequencies above the first frequency band, thus producing the flow sound output. The magnet 60 has a larger mass compared to the cone 52; therefore, it causes substantially no vibration above 500 Hz.

The magnet 60 as the second vibration system is designed to cause resonance in the second frequency band ranging from 130 Hz to 145 Hz. However, since the second frequency band is lower than the first frequency band in which the cone 52 causes resonance, the cone 52 hardly causes resonance, while only the magnet 60 moves. Therefore, no sound is generated, while vibration is generated. As described above, they operate in different frequency bands respectively so that the cone 52 constituting the first vibration system generates sound, while the magnet 60 constituting the second vibration system generates vibration.

The vibration speaker 50 used in the present embodiment is designed in such a manner that as the second vibration system, the magnet 60 causes vibration. It is not necessarily limited by the present embodiment. For example, instead of the magnet 60, a vibration mass (load mass) is connected to the cone by the intervention of a compliance. Hence, the present invention is applicable to one in which the vibration mass is used for the second vibration system. That is, the present invention is applicable to the vibration speaker that comprises a frame having at least one opening, a vibrating plate attached to the frame, an excitation coil attached to the vibrating plate via a bobbin, a magnetic circuit that is arranged to produce magnetic drive force with respect to the excitation coil, and a load having a prescribed weight that is connected to the vibrating plate via a means having a mechanical or acoustic compliance. When low-frequency electric signals are applied to the excitation coil, the load and the vibrating plate integrally vibrate together by means of the means having the compliance. When audio-frequency electric signals are applied to the excitation coil, the means having the compliance substantially blocks the vibration force so that only the vibrating plate vibrates to cause sound, which is output from the opening of the frame.

Fourth Embodiment

Figure 10:
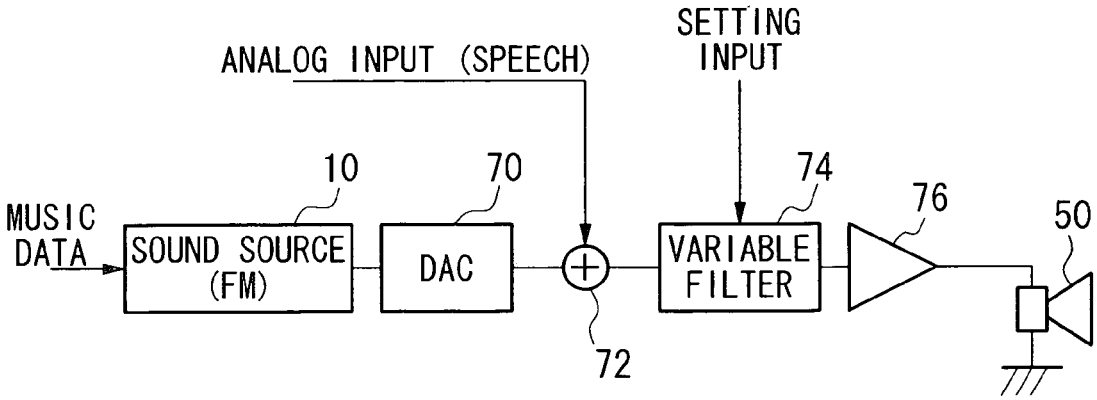
FIG. 10 is a block diagram showing the configuration of a vibration source driving device in accordance with a fourth embodiment of the present invention.

Next, FIG. 10 shows the configuration of the vibration source driving device in accordance with the fourth embodiment of the present invention. In this figure, the vibration source driving device of the fourth embodiment comprises a sound source (e.g., an FM sound source) 10 for generating musical tone signals based on input music data, a DA converter (DAC) 70 for performing digital-to-analog conversion on the musical tone signals of the sound source 10, an adder 72 as an addition means for adding together the output signal of the DA converter 70 and the analog input (e.g., speech signals) from the external device, a variable filter 74 whose frequency band allowing transmission of input signals therethrough can be changed by the setting signal input from the external device, an amplifier 76 as a drive means for driving a vibration speaker 50 based on the output signal of the variable filter 74.

Figure 11:
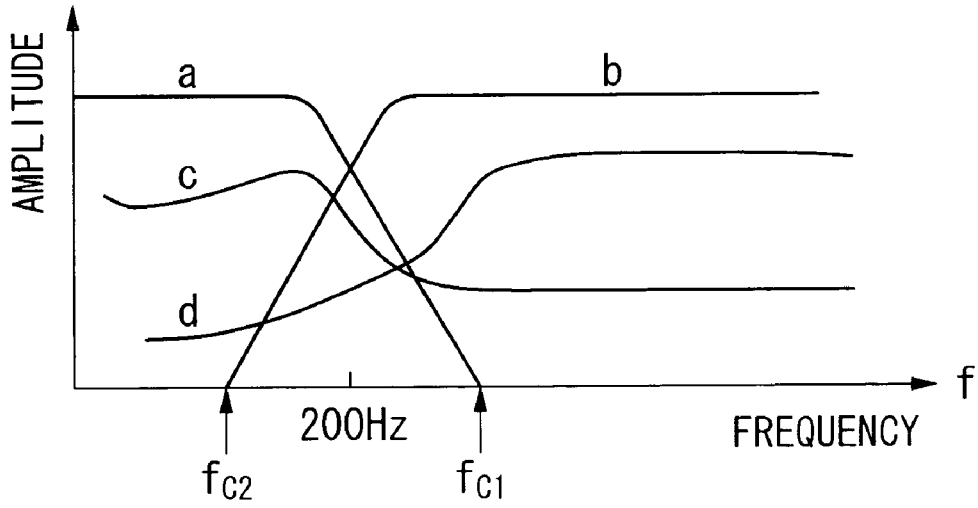
FIG. 11 is a characteristic graph showing frequency characteristics of a variable filter shown in FIG. 10.

As shown in FIG. 11, filter constants are set in such a way that the variable filter 74 has a frequency characteristic (curve a) of a low-pass filter whose cutoff frequency fc1 matches the upper-limit frequency of the aforementioned second frequency band when the vibration speaker 50 functions as only the vibrator; it has a frequency characteristic (curve b) of a high-pass filter whose cutoff frequency fc2 matches the lower-limit frequency of the aforementioned first frequency band when the vibration speaker 50 functions as the speaker for reproducing sound signals; and it is placed in a through state allowing transmission of all signals therethrough when the vibration speaker 50 functions to reproduce sound signals while simultaneously generating vibration.

The filter constants are set in such a way that the variable filter 74 has frequency characteristics for enabling output adjustment with respect to the sound and vibration in accordance with curves c and d shown in FIG. 11 when it is placed in the through state to allow the vibration speaker 50 to generate both the sound and vibration. Thus, it is possible to produce new effects by both the sound and vibration.

In the aforementioned configuration, the sound source 10 generates musical tone signals based on input music data, so that the musical tone signals are input to the DA converter (DAC) 70. The musical tone signals are converted to analog signals by the DA converter (DAC) 70, so that the adder 72 adds the analog input such as the speech to the analog signals. Added signals are input to the variable filter 74. The filter characteristic of the variable filter 74 is set in advance in response to the setting of the operation mode regarding incoming calls. That is, by selecting any one of operation modes from among a mode A allowing incoming call notification by only the sound (melody of the tune), a mode B allowing it by only the vibration, and a mode C allowing it by both the sound and vibration, the filter characteristic (frequency characteristic) is set by the setting signal corresponding to each operation mode.

The output signal of the variable filter 74 is amplified by the amplifier 76 and is then applied to the vibration speaker 50. When the mode A is set, the filter constants are set in such a way that the variable filter 74 acts as a high-pass filter, so that the vibration speaker 50 outputs the sound based on signal components, which are provided by eliminating low-frequency components from the musical tone signals output from the sound source 10, or it outputs the speech input from the external device. When the mode B is set, the filter constants are set in such a way that the variable filter 74 acts as a low-pass filter, wherein the variable filter 74 extracts only the low-frequency components from the musical tone signals output from the sound source 10, so that the vibration speaker 50 drives only the magnet 60 to cause vibration.

When the mode C is set, the filter constants are set in such a way that the variable filter 74 is placed in the through state, wherein the musical tone signals output from the sound source 10 and the analog signals such as the speech are all transmitted through the variable filter 74 and are applied to the vibration speaker 50. Therefore, at the incoming call mode, the cone 52 vibrates based on the musical tone signals to produce the sound or speech, while the magnet 60 of the vibration speaker 50 is driven by the low-frequency components of the musical tone signals to cause vibration.

In the vibration source driving device of the fourth embodiment of the present invention, when the vibration speaker is used for the vibration source as the means for actualizing the vibration function on the portable telephone, it can be driven by the normal speaker drive amplifier without using the complicated circuit configuration.

When the portable telephone is set to allow notification of an incoming call by both sound (melody of the tune) and vibration, the vibration occurs in synchronization with the rhythm of the tune that is output as the sound. Therefore, it is possible to obtain an effect that the user can enjoy it without having a feeling of wrongness.

Fifth Embodiment

Figure 12:
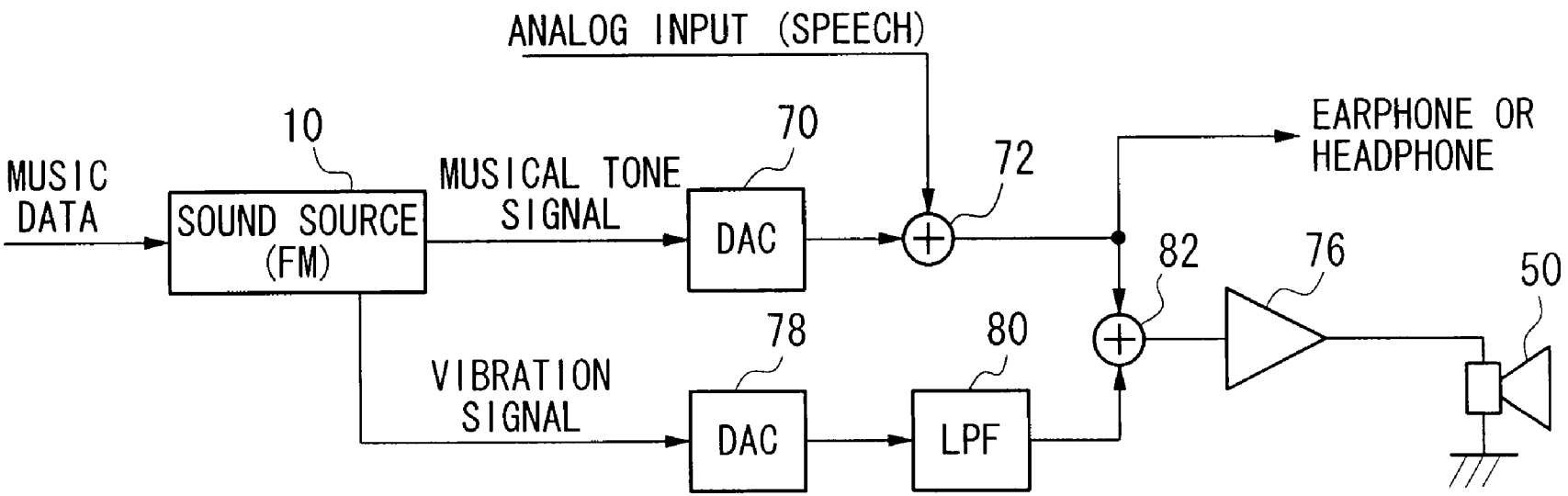
FIG. 12 is a block diagram showing the configuration of a vibration source driving device in accordance with a fifth embodiment of the present invention.

Next, FIG. 12 shows the configuration of the vibration source driving device in accordance with the fifth embodiment of the present invention.

The vibration source driving device of the fifth embodiment differs from the vibration source driving device of the fourth embodiment in configuration in that without using the variable filter, the sound source 10 is forced to generate musical tone signals and vibration signals, wherein the musical tone signals or speech are added to the vibration signals, which are transmitted through a DA converter 78 and a low-pass filter 80, by a newly provided adder 82, so that added signals are used as drive signals for the vibration speaker 50. Other parts of the configuration are similar to the vibration source driving device of the fourth embodiment; therefore, the same parts are designated by the same reference numerals; hence, the duplicate description will be omitted.

In this figure, the vibration source driving device of the fifth embodiment comprises a sound source (e.g., an FM sound source) 10 for generating musical tone signals based on input music data while also generating vibration signals, a DA converter (DAC) 70 for performing digital-to-analog conversion on the musical tone signals of the sound source 10, an adder 72 for adding together the output signal of the DA converter 70 and the analog input (e.g., speech signals), a DA converter (DAC) 78 for performing digital-to-analog conversion on the vibration signals output from the sound source 10, a low-pass filter 80 for eliminating higher harmonics components from the output signal of the DA converter 78, an adder 82 as an addition means for adding together the output signal of the adder 72 and the output signal of the low-pass filter 80, and an amplifier 76 as a drive means for driving the vibration speaker 50 as a vibration source based on the output signal of the adder 82.

Figure 13A:
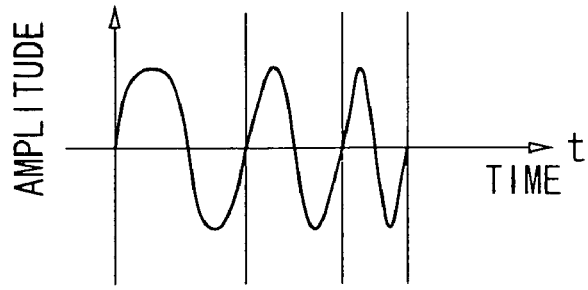
FIG. 13 provide graphs for explaining contents of vibration signals generated by a sound source shown in FIG. 12.

The sound source 10 is the FM sound source, for example. The vibration signals output from the sound source 10 are signals of the frequency band corresponding to the second frequency band (130 Hz to 145 Hz) in which the magnet 60 constituting the second vibration system of the vibration speaker 50 causes resonance; therefore, they are produced by various methods. For example, the vibration signals can be created by connecting multiple sine waves having different frequencies by using the pitch setting function of the FM sound source (see FIG. 13(A)).

Figure 13B:
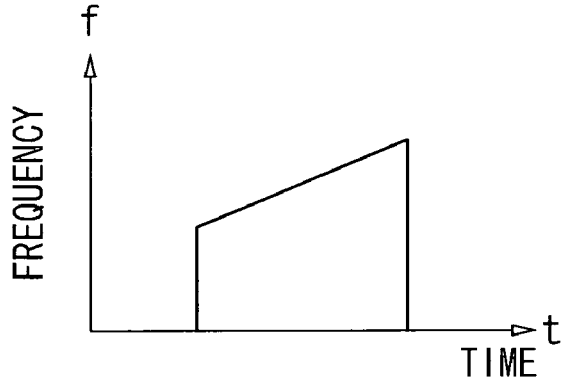
Figure 13C:
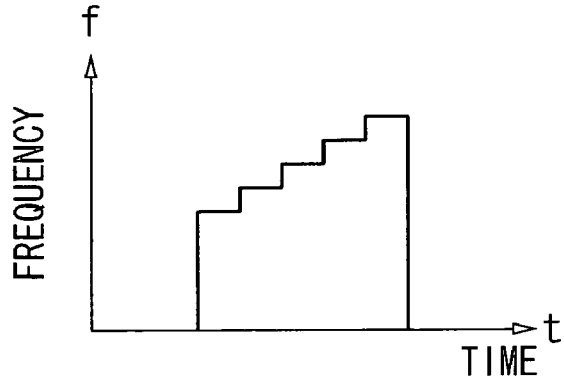
Figure 13D:
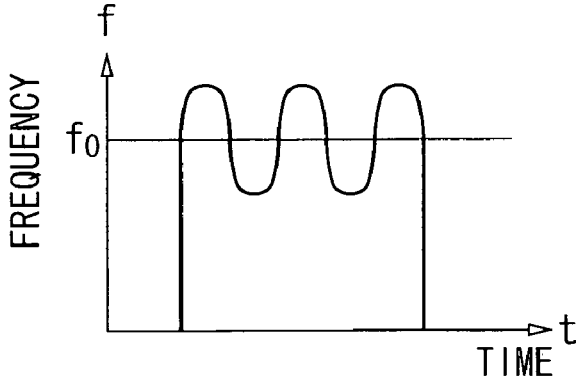

By continuously varying frequencies of signals over a lapse of time (see FIG. 13(B)), or by varying frequencies in a step-like manner over a lapse of time (see FIG. 13(C)), it is possible to create vibration signals of the frequency band corresponding to the aforementioned second frequency band (130 Hz to 145 Hz). Further, by varying frequencies over a lapse of time within the certain width of frequencies about the center frequency f0 of the aforementioned second frequency band (130 Hz to 145 Hz), it is possible to create vibration signals of the frequency band corresponding to the aforementioned second frequency band (130 Hz to 145 Hz) (see FIG. 13(D)).

Figure 14:
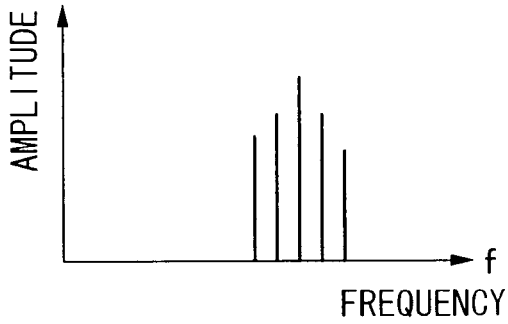
FIG. 14 is a graph for explaining contents of vibration signals generated by the sound source shown in FIG. 12.
Figure 15A:
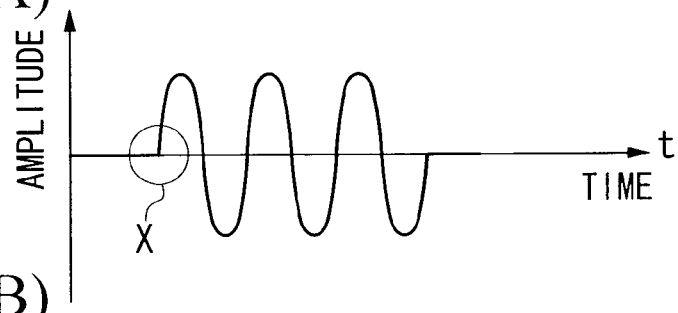
FIG. 15 provides graphs for explaining contents of vibration signals generated by the sound source shown in FIG. 12.
Figure 15B:
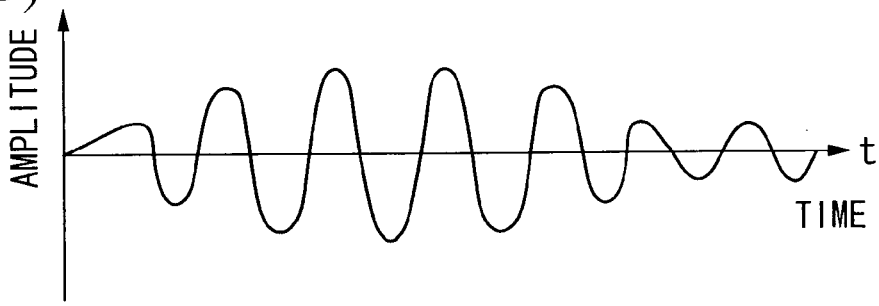

By effecting amplitude modulation with respect to carrier waves in the amplitude modulation section built in the sound source 10, in other words, by generating sidebands using the envelope setting function of the FM sound source and distributing frequency spectra, it is possible to create vibration signals of the frequency band corresponding to the aforementioned second frequency band (130 Hz to 145 Hz) see FIG. 14). In the creation of the vibration signals, higher harmonics occur at the rise portion X of the vibration signal shown in FIG. 15(A). In order to avoid it, by smoothly varying amplitudes of vibration signals using the pitch setting function and envelope setting function of the FM sound source and varying frequencies over a lapse of time as shown in FIG. 15(B), it is possible to create vibration signals of the frequency band corresponding to the aforementioned second frequency band (130 Hz to 145 Hz).

Figure 16:
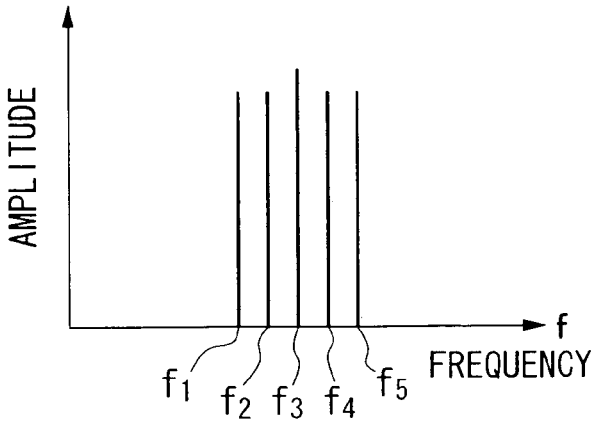
FIG. 16 is a graph for explaining contents of vibration signals generated by the sound source shown in FIG. 12.

As the other method other than the aforementioned ones, by effecting multiplex modulation on carrier waves to generate sidebands and distributing frequency spectra to produce multiple sound in proximate to the center frequency f0 of the second frequency band (130 Hz to 145 Hz) as shown in FIG. 16, it is possible to create vibration signals of the frequency band corresponding to the aforementioned second frequency band. In FIG. 16, f1=130 Hz, f2=132 Hz, f3=134 Hz, f4=136 Hz, and f5=138 Hz, for example.

Figure 17A:
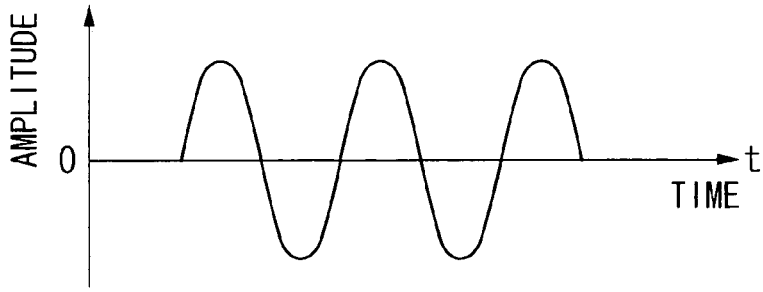
FIG. 17 provides graphs for explaining contents of vibration signals generated by the sound source shown in FIG. 12.
Figure 17B:
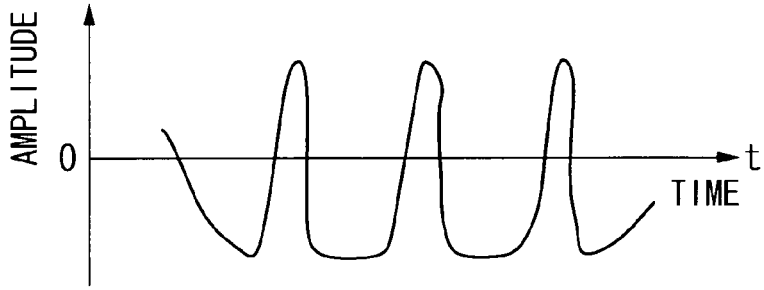

As shown in FIG. 17, the sound source 10 is forced to generate as vibration signals the signals whose signal waveforms are deformed and which are created by convoluting low-frequency signals (FIG. 17(A)) with higher harmonics. By driving the vibration speaker 50 by these signals, it is possible to vary vibration feelings.

Figure 18:
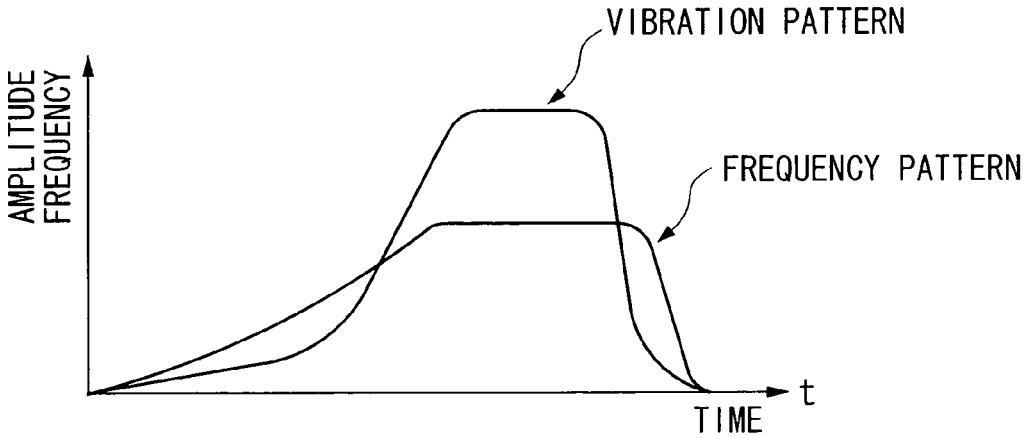
FIG. 18 is a graph for explaining contents of vibration signals generated by the sound source shown in FIG. 12.

The present embodiment uses the vibration speaker as the vibration source; however, when a vibration motor constituting a vibration of the portable telephone is used, it is possible to use as vibration signals the signals that are created by simulating the vibration pattern (frequency and amplitude of vibration) of the vibration motor shown in FIG. 18; in other words, it is possible to use these signals as drive signals for the vibration motor.

In the configuration shown in FIG. 12, the sound source 10 outputs musical tone signals and vibration signals to the DA converters 70 and 78 respectively. The DA converter 70 converts the musical tone signals to analog signals, which are added to the analog input such as the speech by the adder 72. The output of the adder 72, that is, the musical tone signals or speech signals, is output to the earphone (or headphone) or the adder 82.

On the other hand, the DA converter 78 converts the vibration signals to analog signals, from which higher harmonics components are eliminated by the low-pass filter 80; then, these signals are added to the musical tone signals or speech signals by the adder 82. As described above, the addition output representing the result of the addition between the musical tone signals or speech signals and the vibration signals is amplified by the amplifier 76 and is then applied to the vibration speaker 50. The vibration speaker 50 produces the sound based on the musical tone signals or speech signals in the aforementioned first frequency band, and it also causes vibration based on the vibration signals generated by the sound source 10 in the second frequency band.

In the vibration source driving device of the fifth embodiment of the present invention, when the vibration speaker is used for the vibration source as the means for actualizing the vibration function on the portable telephone, it can be driven by the normal speaker drive amplifier without using the complicated circuit configuration.

When the portable telephone is set to allow notification of an incoming call by both sound (melody of the tune) and vibration, it is possible to generate vibrations having different characteristics by the vibration signals generated by the sound source. Therefore, it is possible to obtain an effect that the user can enjoy it without having a feeling of wrongness.

Sixth Embodiment

Figure 19:
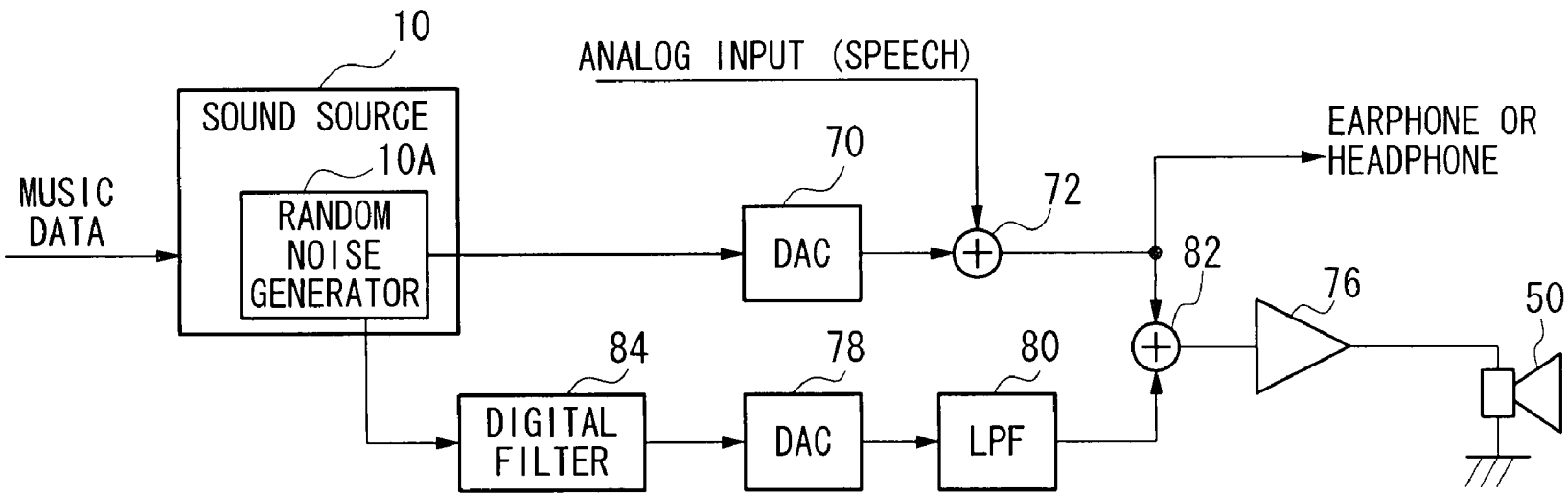
FIG. 19 is a block diagram showing the configuration of a vibration source driving device in accordance with a sixth embodiment of the present invention.

Next, FIG. 19 shows the configuration of the vibration source driving device of the sixth embodiment of the present invention. The vibration source driving device of the sixth embodiment differs from the vibration source driving device of the fifth embodiment in configuration in that a digital filter 84 is newly provided and is used to extract signals of the prescribed frequency band in proximity to the center frequency f0 of the second frequency band, in which the magnet 60 of the vibration speaker 50 causes resonance, from the random noise output from a random noise generator 10A provided inside of the sound source 10 with respect to vibration signals for driving the vibration speaker 50 as the vibration source, so that the extracted signals are used as the vibration signals. Other parts of the configuration are identical to the foregoing embodiment; hence, the duplicate description will be omitted.

In the vibration source driving device of the sixth embodiment, similar to the vibration source driving device of the fifth embodiment, when the vibration speaker is used for the vibration source as the means for actualizing the vibration function on the portable telephone, it is possible to obtain an effect that the vibration speaker can be driven by the normal speaker driver amplifier without using the complicated circuit configuration.

Seventh Embodiment

Figure 20:
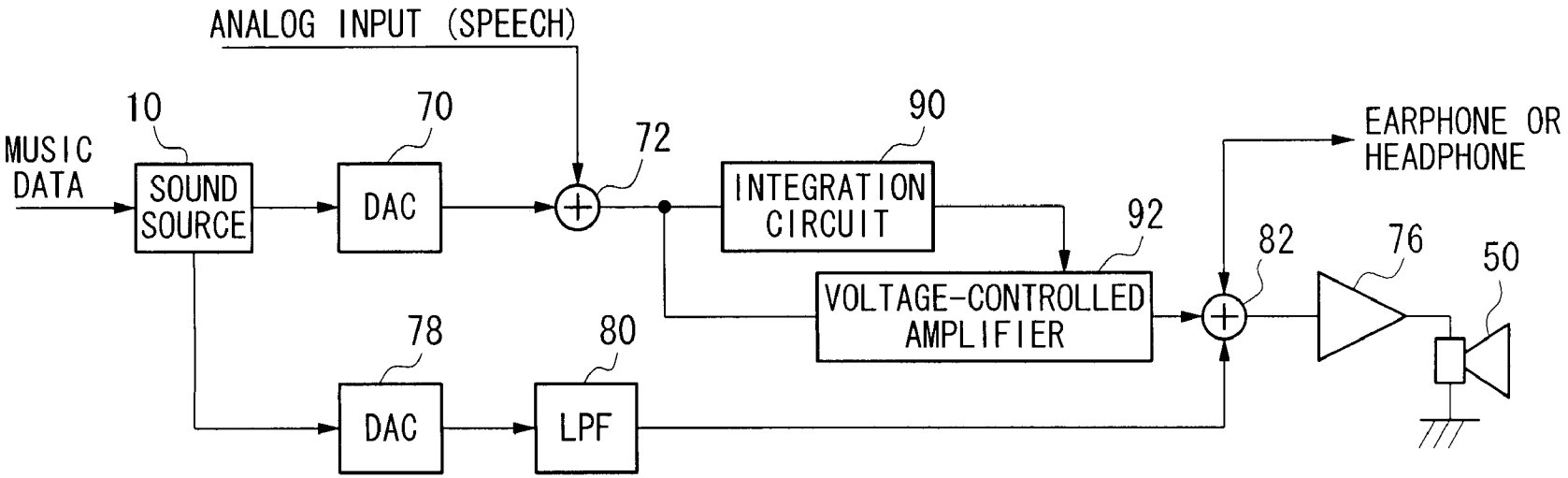
FIG. 20 is a block diagram showing the configuration of a vibration source driving device in accordance with a seventh embodiment of the present invention.

Next, FIG. 20 shows the configuration of the vibration source driving device of the seventh embodiment of the present invention. The vibration source driving device of the seventh embodiment differs from the vibration source driving device of the fifth embodiment shown in FIG. 12 in configuration in that an integration circuit 90 and a voltage-controlled amplifier 92 whose gain is controlled based on the output signal of the integration circuit 90 are provided between the adders 72 and 82 shown in FIG. 12. Other parts of the configuration are identical to the foregoing embodiment, wherein the same parts are designated by the same reference numerals; hence, the duplicate description will be omitted.

In the vibration source driving device of the seventh embodiment, when the portable telephone is et to allow notification of an incoming call by both sound and vibration, the musical tone signals might been subjected to modulation due to vibration caused by driving the magnet 60 of the vibration speaker 50, hence, such modulation should be eliminated.

In FIG. 20, when the portable telephone is set to allow notification of an incoming call by both sound and vibration, the sound source 10 outputs musical tone signals and vibration signals to the DA converters (DAC) 70 and 78 respectively. The DA converter 70 converts the musical tone signals to analog signals, which are added to the analog input (e.g., speech) from the external device by the adder 72, so that the added signals are output to the integration circuit 90. In addition, the DA converter 78 converts the vibration signals to analog signals, from which higher harmonics components are eliminated by the low-pass filter 80; then, they are output to the adder 82. Further, the vibration signals are added to the output signal of the voltage-controlled amplifier 92 by the adder 82, so that the added signals are applied to the vibration speaker 50 via the amplifier 76. The output of the adder 82 is provided to the earphone or headphone.

Meanwhile, the musical tone signals are subjected to amplitude modulation due to the vibration that is caused by driving the magnet 60 of the vibration speaker 50. Hence, the integration circuit 90 detects the vibration waveform of the magnet 60 of the vibration speaker 50 from the output signal of the adder 72, so that the gain of the voltage-controlled amplifier 92 is controlled based on the output signal of the integration circuit 90. Thus, the amplitude modulated components of the output signal of the adder 72 are reversely corrected. In result, it is possible to reduce the modulation components, due to the vibration of the magnet 60 of the vibration speaker 50, within the musical tone signals.

As described above, in the vibration source driving device of the seventh embodiment of the present invention, the integration circuit 90 detects the vibration waveform of the magnet 60 of the vibration speaker 50 from the output signal of the adder 72 that adds together the musical tone signals and the externally input signals, so that by controlling the gain of the voltage-controlled amplifier 92 based on the output signal of the integration circuit 90, the amplitude modulated components of the output signal of the adder 72 are reversely corrected. Therefore, when the portable telephone is set to allow notification of an incoming call by both sound and vibration, it is possible to reduce the modulation components of the musical tone signals due to the vibration that is caused by driving the magnet 60 of the vibration speaker 50.

Eighth Embodiment

Figure 21:
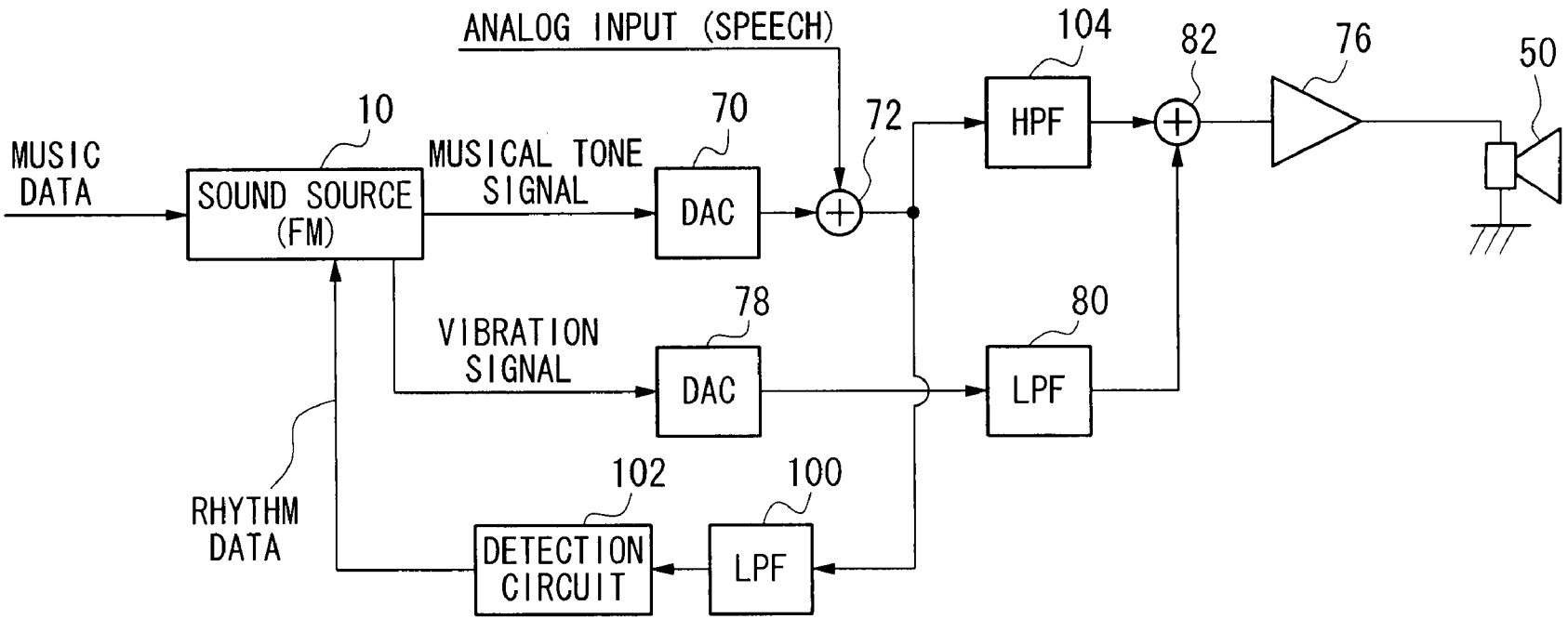
FIG. 21 is a block diagram showing the configuration of a vibration source driving device in accordance with an eighth embodiment of the present invention.

Next, FIG. 21 shows the configuration of the vibration source driving device of the eighth embodiment of the present invention. The vibration source driving device of the eighth embodiment is designed such that signals, which are produced by eliminating low-frequency components from musical tone signals output from the sound source, and vibration signals, which are synchronized with the rhythm within the musical tone signals output from the sound source, are added together, so that the vibration speaker is driven by the addition output.

In FIG. 21, when the portable telephone is set to allow notification of an incoming call by both sound (melody of the tune) and vibration, the vibration source driving device of the present embodiment comprises a sound source 10 (e.g., an FM sound source) that generates musical tone signals based on input music data and that also generates vibration signals in synchronization with rhythm data within the musical tone signals, a DA converter (DAC) 70 for performing digital-to-analog (D/A) conversion on the musical tone signals of the sound source 10, an adder 72 for adding together the output signal of the DA converter 70 and the analog input (e.g., speech signals) provided from the external device, a DA converter (DAC) 78 for performing digital-to-analog (D/A) conversion on the vibration signals output from the sound source 10, and a low-pass filter 80 for eliminating higher harmonics components from the output signal of the DA converter 78.

Further, the vibration source driving device of the present embodiment also comprises a high-pass filter 104 for eliminating low-frequency components from the output signal of the adder 72 to extract high-frequency components only, an adder 82 as an addition means for adding together the output signal of the high-pass filter 104 and the output signal of the low-pass filter 80, an amplifier 76 as a drive means for driving the vibration speaker 50 as the vibration source based on the output signal of the adder 82, a low-pass filter 100 for extracting low-frequency components from the musical tone signals output from the adder 72, and a detection circuit 102 for detecting the output signal of the low-pass filter 100 to detect and output rhythm data to the sound source. The low-pass filter 100 and the detection circuit 102 correspond to the rhythm data detection means of the present invention.

In the aforementioned configuration, when the portable telephone is set to allow notification of an incoming call by both sound (melody of the tune) and vibration, the sound source 10 outputs musical tone signals based on input music data to the DA converter 70. The DA converter 70 converts the musical tone signals to analog signals, which are added to the analog input (e.g., speech signals) input from the external device by the adder 72, so that the added signals are output to the high-pass filter 104 and the low-pass filter 100 respectively. The low-pass filter 100 extracts from the musical tone signals the low-frequency components, which are detected by the detection circuit 102 and are output to the sound source 10 as the rhythm data. The sound source 10 generates vibration signals in synchronization with the rhythm data output from the detection circuit 102, so that they are output to the DA converter 78. The DA converter 78 converts the vibration signals to analog signals, from which higher harmonics components are eliminated by the low-pass filter 80, so that they are output to the adder 82.

The adder 82 adds together the output signal of the high-pass filter 104 and the output signal of the low-pass filter 80, in other words, it adds together the musical tone signals, from which the low-frequency components are eliminated, and the vibration signals that are synchronized with the rhythm data within the musical tone signals. Then, the added signals are output to the amplifier 76 as the drive means. The amplifier 76 drives the vibration speaker 50 based on the output signal of the adder 82.

In the vibration source driving device of the eighth embodiment of the present invention, when the vibration speaker is used for the vibration source as the means for actualizing the vibration function on the portable telephone, it is possible to obtain an effect that the vibration speaker can be driven by the normal speaker drive amplifier without using the complicated circuit configuration. When the portable telephone is set to allow notification of an incoming call by both sound (melody of the tune) and vibration, the vibration is generated in synchronization with the rhythm of the tune that is output as the sound. Therefore, it is possible to obtain an effect that the user can enjoy it without having a feeling of wrongness.

Ninth Embodiment

Figure 22:
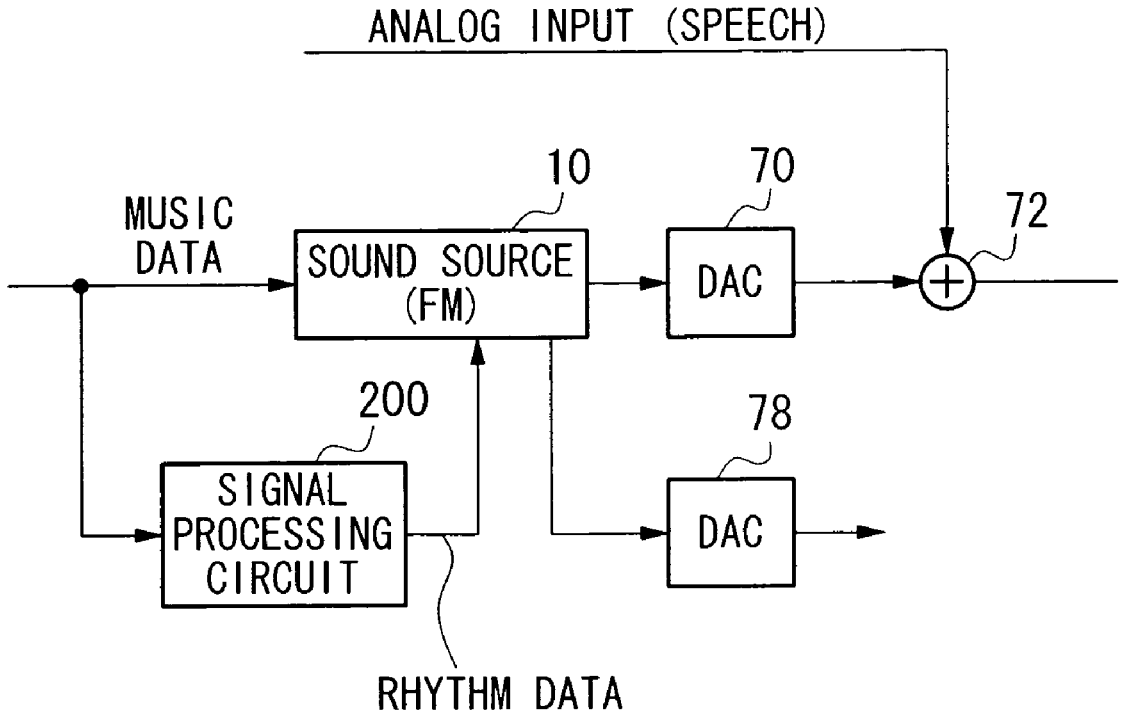
FIG. 22 is a block diagram showing the configuration of a vibration source driving device in accordance with a ninth embodiment of the present invention.

Next, FIG. 22 shows the configuration of essential parts of the vibration source driving device in accordance with the ninth embodiment of the present invention. The vibration source driving device of the present embodiment differs from the vibration source driving device of the eighth embodiment in configuration in that the vibration source driving device of the eighth embodiment detects rhythm data by use of the low-pass filter 100 and the detection circuit 102, whereas a signal processing circuit 200 is used to extract rhythm data from music data input to the sound source, so that by supplying the rhythm data to the sound source, the sound source is forced to generate vibration signals in synchronization with the rhythm data. Other parts of the configuration are identical to the foregoing embodiment; hence, the duplicate description will be omitted.

In the vibration source driving device of the ninth embodiment of the present invention, similar to the vibration source driving device of the eighth embodiment, when the vibration speaker is used for the vibration source as the means for actualizing the vibration function on the portable telephone, it is possible to obtain an effect that the vibration speaker can be driven by the normal speaker amplifier without using the complicated circuit configuration.

When the portable telephone is set to allow notification of an incoming call by both sound (melody of the tune) and vibration, the vibration is generated in synchronization with the rhythm of the tune that is output as the sound. Therefore, it is possible to obtain an effect that the user can enjoy it without having a feeling of wrongness.

The invention claimed is:

1. A vibration source driving device comprising:

a sound source for generating a musical tone signal in response to music data and for generating a vibration signal in synchronization with rhythm data within the music data;

at least one digital to analog converter (DAC) to perform digital to analog conversion on an output of the sound source selected from the group consisting of the musical tone signal and the vibration signal;

a vibration source that provides a first vibration system for causing resonance in a first frequency band and a second vibration system for causing resonance in a second frequency band that is lower than the first frequency band, so that the first vibration system generates sound, and the second vibration system generates vibration;

a rhythm data detection means for detecting rhythm data from the musical tone signal output from the sound source, thus outputting the rhythm data to the sound source to cause the sound source to generate the vibration signal in synchronization with the rhythm data;

a high-pass filter for eliminating low-frequency sounds from the musical tone signal;

a low-pass filter for eliminating higher harmonics components from the vibration signal;

an addition means for adding together an output signal of the high-pass filter and an output signal of the low-pass filter; and a drive means for driving the vibration source based on an output signal of the addition means.

2. The vibration source driving device of claim 1, wherein the vibration source is a vibration speaker.

3. The vibration source driving device of claim 1, wherein the sound source is an FM sound source.

4. The vibration source driving device of claim 1, wherein the sound source utilizes pulse code modulation to generate the musical tone signal.

5. A vibration source driving device comprising:

a sound source for generating a musical tone signal in response to music data and for generating a vibration signal;

a first digital to analog converter (DAC) to perform digital to analog conversion on the musical tone signal of the sound source;

an analog input;

a second DAC to perform digital to analog conversion on the vibration signal generated by the sound source;

a low pass filter to eliminate higher harmonics components from the output signal of the second DAC;

a first addition means to add an output signal of the first DAC and the analog input;

a second addition means to add an output signal of the first addition means and an output signal of the low pass filter; and a drive means to drive a vibration speaker based on an output signal of the second addition means.

6. The vibration source driving device of claim 5, wherein the sound source is an FM sound source.

7. The vibration source driving device of claim 5, wherein the analog input is a speech signal.

* * * * *